United States Patent [19]

Hart

[11] Patent Number: 4,497,384

[45] Date of Patent: Feb. 5, 1985

[54] REAMER DISASSEMBLY

[75] Inventor: Lawrence D. Hart, Houston, Tex.

[73] Assignee: Smith International, Inc., Newport Beach, Calif.

[21] Appl. No.: 336,804

[22] Filed: Jan. 4, 1982

[51] Int. Cl.[3] ..... E21B 12/00

[52] U.S. Cl. ..... 175/315; 29/253; 29/275; 254/104; 175/347

[58] Field of Search ..... 175/315, 345, 346, 34 T; 29/275, 270, 253; 81/3 R; 254/104

[56] References Cited

U.S. PATENT DOCUMENTS

| | | | |
|---|---|---|---|
| 303,888 | 8/1884 | Sharp | 254/104 |
| 2,079,745 | 5/1937 | Maney | 254/104 |
| 4,182,425 | 1/1980 | Garrett | 175/228 |

FOREIGN PATENT DOCUMENTS

| | | | |
|---|---|---|---|
| 74684 | 7/1932 | Sweden | 254/104 |

*Primary Examiner*—James A. Leppink
*Assistant Examiner*—Michael Starinsky

[57] ABSTRACT

A wall contacting device, such as a roller reamer used in earth boring, includes a block, e.g. supporting one end of a roller shaft, making an interference fit with a socket in the body of the device, there being tool passage means between the body and block; a disassembly tool is removably received in the passage and includes a pressure portion engaged with the block and a head portion to receive impact; and cooperating guide means on the body and tool includes coaxial cylindric surfaces on the body and tool for supporting the tool for rotation about a fixed axis, the pressure portion of the tool being a portion of an Archimedian spiral coaxial with the cylindric surfaces.

12 Claims, 25 Drawing Figures

49
65
49
47
41
43
78
52
84
79
90
86
80
82
33
81
85
83
75
82
77
53
41
47
43
65
35
56
47
52
39
55
64
54
33
21
37
81
54
82
39
64
53
55
6
6
56
47
23
49
24

Fig. 2
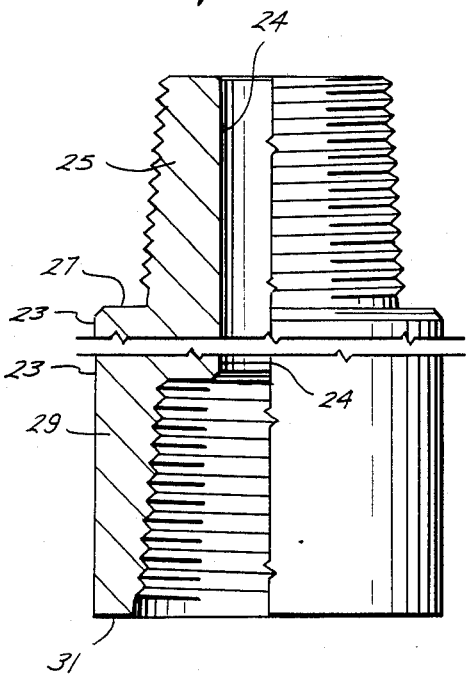
Fig. 4
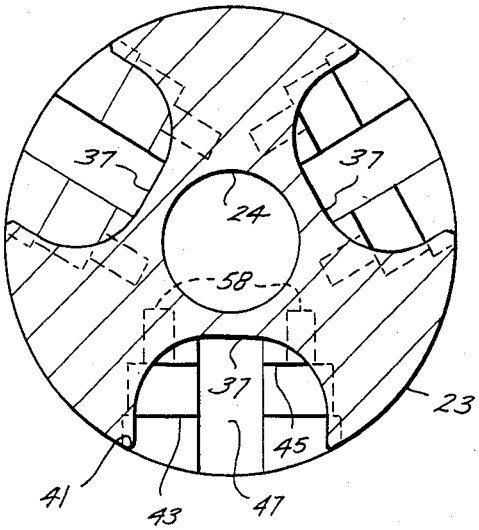
Fig. 3
Fig. 5
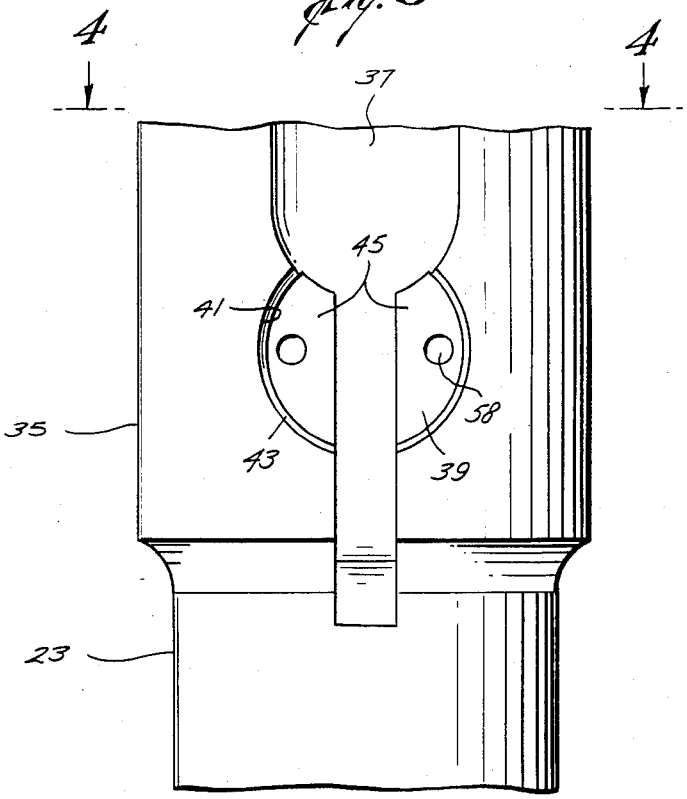

NOTE: THE CURVE SEGMENT FROM POINT A TO TANGENT POINT OF 3.0" DIA. CURVE SEGMENT (POINT B) IS DEFINED BY THE RELATIONS;
$x = \cos\theta(6.3 - 2.3658\theta)$ $y = \sin\theta(6.3 - 2.3658\theta)$
$\theta$ IN RADIANS

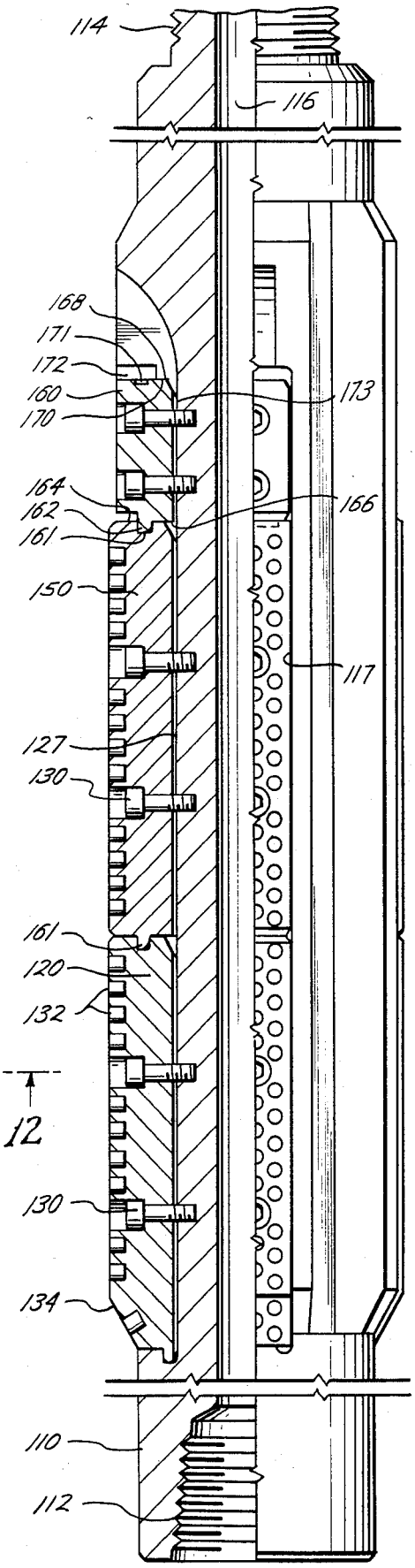
Fig. 11
Fig. 13
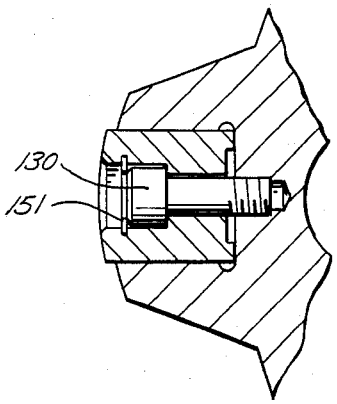
Fig. 12
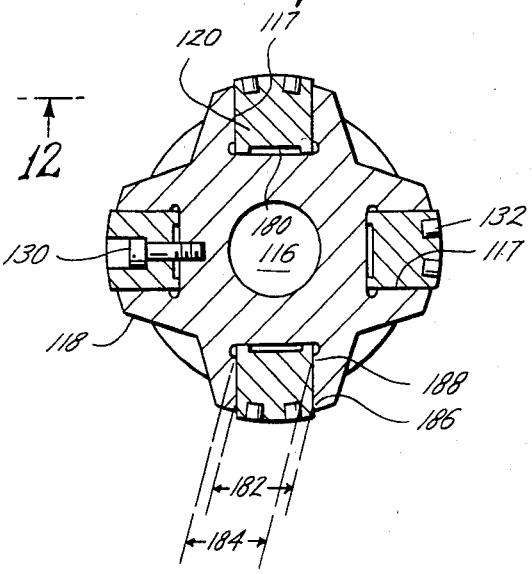

REAMER DISASSEMBLY

BACKGROUND OF THE INVENTION

This invention relates to apparatus and method for disassembly of a wall contacting device, e.g., a roller reamer (see U.S. Pat. Nos. 4,182,425 and 4,261,426 to W. R. Garrett) or a replaceable blade stabilizer (see U.S. patent application Ser. No. 287,769 filed July 29, 1981 by W. R. Garrett), used in drilling wells by the rotary method. The foregoing patents and application are incorporated herein by reference.

More particularly the invention relates to a wall contacting device having a block inserted into a socket with an interference fit and provided with tool access means to admit a wedge type block removal tool between the block and socket.

BRIEF DESCRIPTION OF THE PRIOR ART

Heretofore, as disclosed in the aforementioned Garrett patents and application, it has been known to use a tool to drive a block from the socket with which it makes an interference fit. The tool is formed by bevelling the end of a square bar to form a wedge, the remainder of the bar forming a handle which transmits force to the wedge when the end of the bar is struck with a hammer. The length of the bar extends the point of application of the hammer blow to an accessible location outside the reamer body, whereas the wedge tip of the tool is adapted to be received via a tool access slot into a location between the block and the body of the device in which is formed the socket.

The motion of the tool and its handle and wedge tip when a hammer blow is applied is supposed to be one of translation, the hammer blow being applied along the axis of the handle bar, and the flat side of the wedge that engages the body via the tool access slot sliding along the slot parallel to the inner face of the block, which is usually also parallel to the axis of the wall contacting device. The outer edge of the tool slides under the edge of the block and forces it out of the socket.

A number of problems have been encountered with the above-mentioned removal tool disclosed in the Garrett patent and application; as follows:

(1) In some cases, with large diameter reamers, the blocks could not be removed.

(2) Repeated use of the tool caused destruction of the wedge tip, e.g., by its breaking off.

(3) The wedge tip sometimes gouged or galled the tool access passage in the reamer body.

(4) Frequently, the tool rebounded after being struck, so that chains or other anchor means needed to be used to hold down the tool and prevent injury to the user.

(5) Frequently, the tool was struck other than in line with its handle, or missed entirely, causing damage to the too or the device.

(6) With the device (reamer) lying with its axis horizontal, as is most convenient for supporting the device, the hammer must be swung in an arc inclined to the vertical by an angle equal to 90° minus the wedge angle. Since the wedge angle is usually about 20°, the hammer is only 20° from a horizontal plane, in which plane it is very difficult and tiring to swing a hammer, e.g., a ten pound sledge hammer.

It is the object of the present invention to overcome the aforementioned problems.

The first Garrett patent also mentions the use of a wedge in cooperation with a ramp in the bottom of the tool access slot to conform the plane of the outer surface of the wedge to the inner surface of the block, but this construction did not prove to be advantageous over the simple wedge making contact only with the edge of the block despite the fact that the latter arrangement tends to cock the block in the socket.

The second Garrett patent shows that the tool access slot may have a curved entrance portion, but this is merely the convenient shape for the run-out of a broach used to form the slot, the knock out tool or wedge there shown not cooperating with the curved entrance during block removal.

The Garrett patent application also mentions that a pulling tool may be used rather than a driven wedge. For example the wedge tool may be used as a second class lever to force the block out of the socket. However, the pulling force exertable manually is not nearly as large as the force exerted by a sledge hammer decelerating upon impact.

A search of the prior art made in connection with the present invention turned up the following U.S. patents:

U.S. Pat. No. 2,758,651—Mork

U.S. Pat. No. 3,149,414—Bell

The Mork patent merely discloses a wedge to drive a curved knife blade with a groove to remove a seal ring by an action similar to the aformentioned gouging action of the tool of the Garrett patent.

The Bell patent discloses a cam type ejector key to be rotated in a chuck to force out a tool; the action is that of a lever to which force is applied manually by a crank arm.

Attention has also been directed to U.S. patent number:

U.S. Pat. No. 2,977,165—Olson which discloses the use of a screw driver as a lever to expand a snap ring around a piston body.

None of the foregoing solves the problems encountered with the known block removal tools for use with wall contacting devices such as reamers.

SUMMARY OF THE INVENTION

The present invention provides an apparatus and method for disassembly of a wall contacting device. The disassembly tool is a curved wedge which fits within a passage in the body of the wall contacting device. Within the passage, a portion of the disassembly tool engages a block making an interference fit with a socket. Another portion of the disassembly tool is exposed to the exterior. Force, e.g., from a sledge hammer, exerted on the exterior portion of the disassembly tool allows the disassembly tool to move within the passage and to drive the block out of the socket.

The passage in the body of the wall contacting device includes a curved bearing surface which cooperates with the bearing surface of the disassembly tool. Because of the cooperating bearing surfaces of the passage and the tool are both cylindric, the tool is constrained to rotate about a stationary axis.

Assuming the wall contacting device (reamer or stabilizer) is lying on its side with its body axis horizontal, a downward force direction perpendicular to the axis of the body of the device produces a movement of the block in the opposite direction, i.e. upward perpendicular to the axis of the body.

The cylindric bearing surface in the body of the device is tangent to a surface of the tool access passage which latter surface is a plane parallel to the body axis adjacent the bottom of the socket. The cylindric surface joins the plane surface along a line lying in a plane perpendicular to the body axis that passes through the edge of the block nearest the entrance of the tool access passage. The latter plane also passes through the axis of rotation of the wedge.

The wedge taper relative to block travel distance is such that the tip of the wedge never touches the block. This prevents breaking off the tip.

There is a constant ratio of block travel to angular distance of rotation of the wedge so that the removal operation is smooth. To this end the wedge surface that engages the block has a cross-section that is of Archimedean spiral configuration.

The end of the wedge to which force is applied is cylindric so that it always presents an uppermost surface that is suitable to receive a hammer blow, and slightly misdirected blows will also strike a suitable surface, i.e. one that is not angular and which is relieved at areas around but separated from the area of contact.

There is full support for the reaction side (bottom) of the wedge over the horizontal distance from the place of application of the impact to the place of contact with the block so that there is no tendency to gouge the body at the bottom of the tool passage.

Other objects and advantages of the invention will become apparent from the following description of preferred embodiments thereof, reference being made to the accompanying drawings.

BRIEF DESCRIPTION OF THE DRAWINGS

For detailed descriptions of preferred embodiments of the invention, reference will now be made to the following drawings wherein:

FIGS. 2 and 3 are fragmentary elevations of connection means suitable for the reamer;

FIG. 4 is a section taken at plane 4—4 of FIG. 5, showing the reamer body alone;

FIG. 5 is a fragmentary elevation of the reamer body;

FIG. 11 is a half section through a replaceable blade stabilizer as disclosed in the aforementioned Garrett application, modified in accordance with the present invention;

FIG. 12 is a section taken at plane 12—12 of FIG. 11;

FIG. 13 is a fragmentary enlargement of a portion of FIG. 12;

The drawings are to scale and the conventions of the U.S. Patent and Trademark Office in patent cases have been used to designate materials, from which it will be seen that the parts are all made of metal, e.g. steel, except for the wear buttons which are made of tungsten carbide.

DESCRIPTION OF PREFERRED EMBODIMENTS

1. First Embodiment

Figure 1:
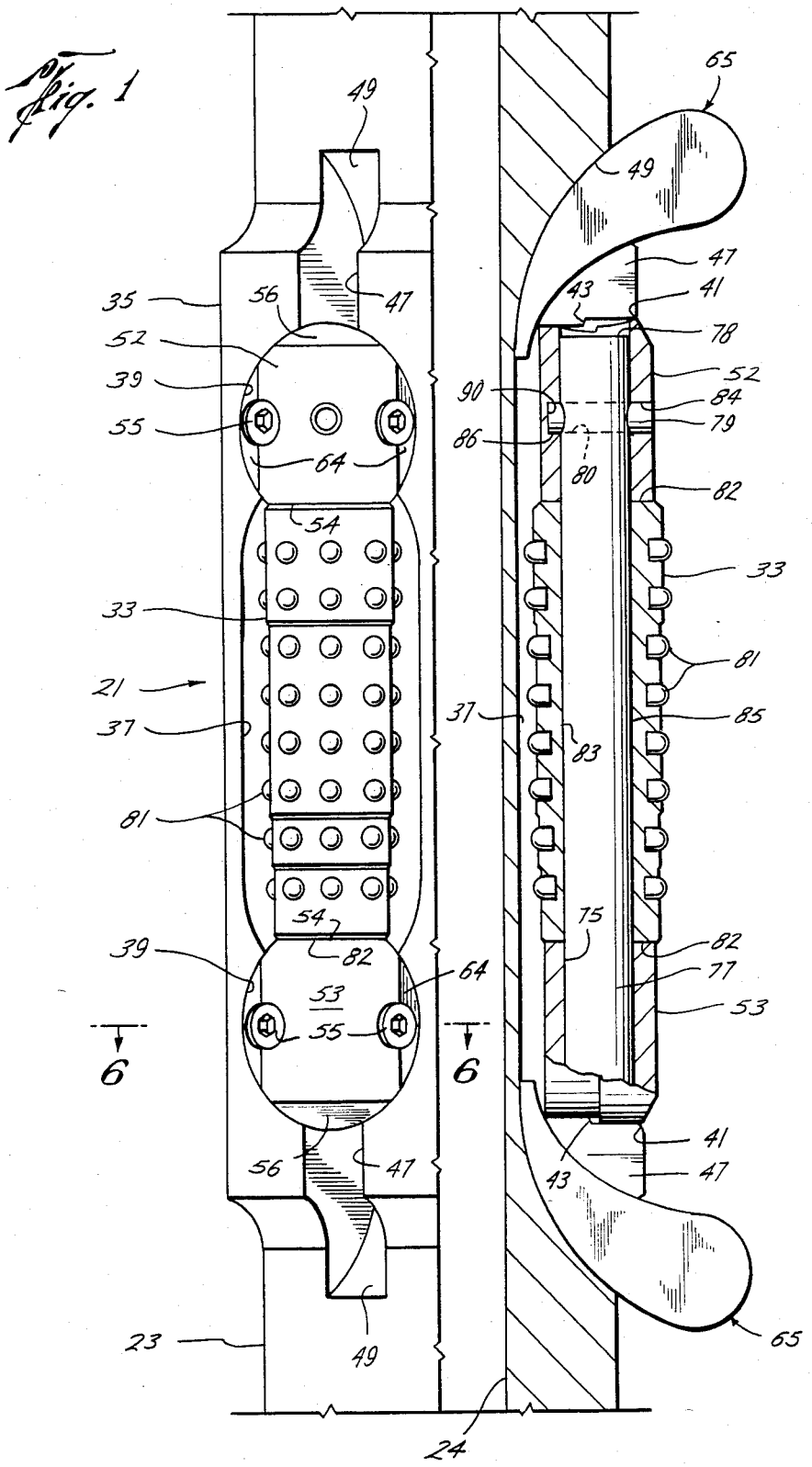
FIG. 1 is a fragmentary half section through an annulus fluid lubricated reamer embodying the invention.

Referring now to FIG. 1 there is shown a reamer 21 comprising a generally cylindrical tubular body 23 having a flow passage 24 extending axially therethrough. Means for making rotary shouldered connections with adjacent drill string members are provided at the upper and lower ends of the body, e.g. a tapered threaded pin 25 and shoulder 27 at the top and a correlative box 29 with shoulder 31 at the bottom, as shown in FIGS. 2 and 3. This arrangement is suitable for a reamer to be run between drill collar and drill bit. If the reamer is to be used higher up in the drill string, the box would be at the top and the pin at the bottom, but the remainder of the reamer would be disposed as shown in FIG. 1, i.e. with the reamer rollers 33 positioned with their largest diameter ends at the top. This result can be effected using only one style of reamer body by reversing the rollers during assembly if the top and bottom halves of body 23 are made identical except for the rotary shouldered connections. For a further disclosure of rotary shouldered connections see U.S. Pat. No. 3,754,609—Garrett.

Referring once more to FIG. 1, and to FIGS. 4 and 5, the mid-portion 35 of body 23 is or larger diameter than the ends adjacent connector means 25–27, 29–31. Within the enlarged portion 35 are formed plurality, e.g. three elongated roller pockets 37. At the upper and lower ends of each pocket are formed block sockets 39. Sockets 39 are generally cylindrical but have reliefs 41 around their mouths and steps in their side walls at 43. The inner ends 45 of the sockets are flat, except where transected by slots 47 which extend from each end of pocket 37. The extreme ends of slots 47 are sloping, as shown at 49.

Figure 6:
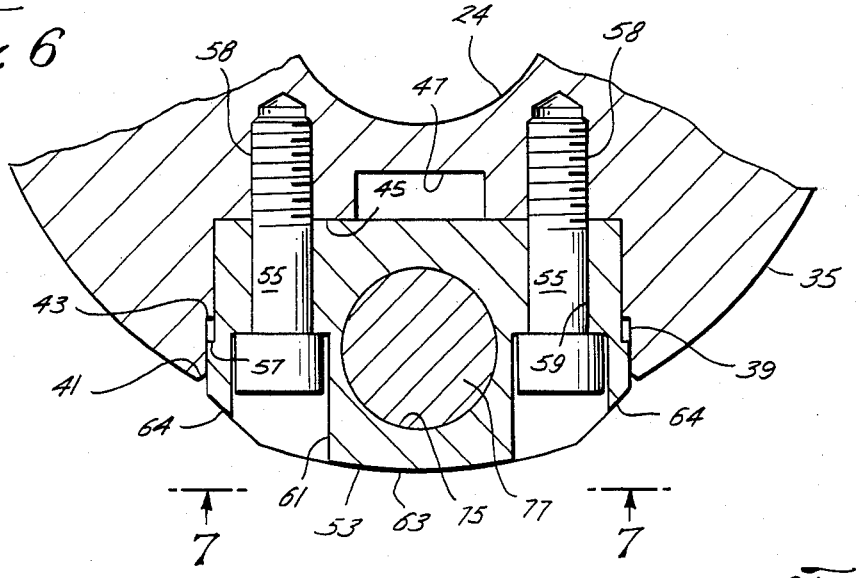
FIG. 6 is a fragmentary section taken at plane 6—6 of FIG. 1 showing the reamer body with roller shafts and blocks in place.
Figure 7:
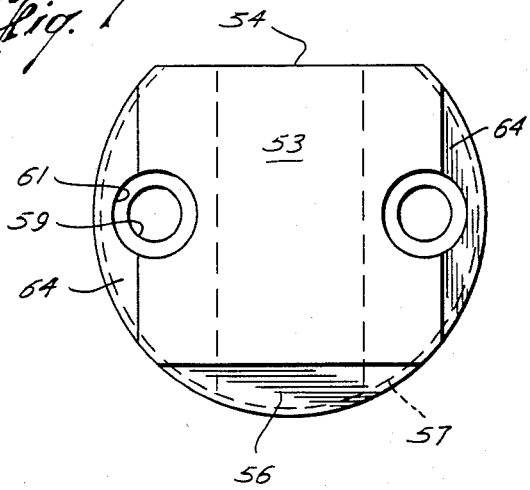
FIG. 7 is a front elevation of a block, as viewed at 7—7 in FIG. 6.
Figure 8:
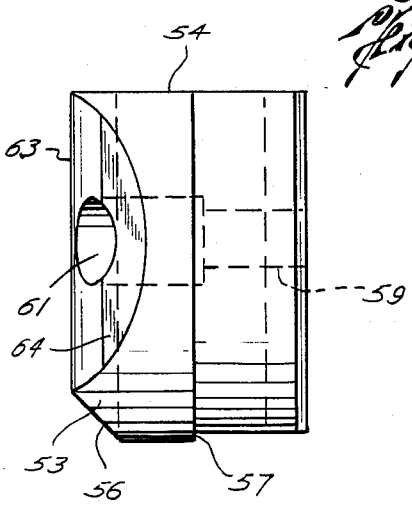
FIG. 8 is a side elevation of a block.

Referring now also to FIGS. 6–8, received within the block sockets 39 are upper and lower blocks 52, 53. The blocks are generally cylindrical plugs but have flat, side positions 54 adjacent sockets 37 and bevels 56 at their opposite sides. The cylindrical side walls of the blocks are stepped at 57 and the parts of the side walls above and below the steps are correlative to the sides of the sockets but the steps do not engage. The blocks made a drive fit with the sockets. The step construction allows easy centering and axial alignment (not canting) before a block is driven into its socket. This avoids broaching the socket as may occur in the case of driving in a canted or otherwise misaligned block. Such broaching is undesirable since it will interfere with proper positioning when the block is removed and replaced and may make removal and replacement with a new block more difficult.

Two cap screws 55 hold each block to the body after the block is driven into place. Threaded bores 57 are provided in the body to receive these screws, and the blocks are provided with unthreaded holes 59 countersunk at 61 through which the screws extend. The heads of the screws are within the envelope of the outer surface 63 of each block, the outer surface 63 being cylindrically curved concentric to the curvature of body portion 35. Outer surface 63 extend beyond the outer periphery of body portion 35 and is provided with lateral bevels 64 merging with body portion 35. Bevels 64 guide the blocks over rough protuberant portions in the bore hole as the reamer rotates therein. This is similar to the purpose of bevels 56 which guide the blocks over such protuberances when the reamer is raised or lowered.

The blocks are provided with cylindrical bores 75 in which are received axles or shafts 77. The shafts have flat ends 78. To prevent the shafts from rotating with the rollers, one end of each shaft 77, e.g. the upper end, is secured to one of the blocks, e.g. 52, by a roll pin 77 passing through a hole 80 in the upper end of the shaft and registering holes 84, 86 in the block, hole 86 having a shoulder 90 to limit the entrance of the roll pin. The roll pin makes an interference (drive) fit within or more of holes 80, 84, 86, to hold it in place. The pins are driven or pressed with place when the shafts becomes worm, the roll pins can be removed and the shafts turned 180 degrees prior to reassembly, thereby to present new, full gage surfaces to support the rollers; alternatively one end of each shaft could be welded to its block, but then it would have to be replaced whenever the shaft is replaced.

The other end of each shaft makes a close fit (snug or slight clearance) with the bore 75 in block 53. This provides firm support but allows the blocks to rock about the shaft axis, and to shift in the direction of the shaft axis, relative to each other, as may be necessary to fit into the sockets 39, but positively retains the shafts within the blocks.

On the shafts 77 are rotatably mounted the rollers or cutters 33. The rollers are stepped and provided with rows of inserted tungsten carbide teeth 81, e.g. as in the aforementioned Garrett U.S. Pat. No. 3,306,381. Other types of earth formation reducing means, e.g. milled teeth or "Q" cutters, as previously mentioned, may be employed.

The ends of the rollers are flat, as indicated at 82, to provide thrust bearing surfaces cooperating with the flat thrust bearing surfaces 54 on the blocks 53. Each roller is a little shorter than the space between the surfaces 54 of the blocks which support its shaft, leaving a little clearance where drilling fluid ouside the reamer can enter and lubricate the thrust bearing surfaces 54, 82, and also the radial bearing surfaces 83, 85 provided by the cylindrical bores 83 of the rollers and the cylindrical outer peripheries 85 of the shafts 75.

Note that the drilling fluid inside the reamer flows through body passage 24 from the threaded box to the threaded pin without contacting the reamer rollers, which are located in the pockets on the exterior of the body; it is only drilling fluid flowing outside the reamer that lubricates the bearings.

The foregoing construction is well suited for drilling with bits whose life is not likely to exceed that of the reaming and bearing surfaces of the reamer rollers, so that no extra trips need be made just to change rollers. For example, the construction is suitable for use with bits not having sealed bearings. Whenever the rollers and shafts do wear out, they are easily replaced because of the special construction of the shaft blocks, and the body is thereby saved and reused. If not worm out the blocks or shafts or both can be reused when the rollers are replaced. As mentioned above, the shafts can be turned 180 degrees when replaced, thereby presenting new, full gage, bearing surfaces to the rollers, since it is the outer portions of the shafts which contact the inner surface of the rollers.

Since the rollers shafts are mounted in holes in blocks set into sockets in the reamer body, the body can be made in one piece. In other words, the end portions of the body, whereat are located the connector means shown in FIGS. 2 and 3 and the sockets 39 receiving the blocks 53, can be made of one piece with the intermediate portion of the body containing roller pocket 37. There is no need to weld or otherwise integrate the end portions with the intermediate portion connecting same. The intermediate portion transmits torque, axil force, and bending moment between the end portions, reducing the strain on the shafts and blocks.

When it is desired to remove blocks 53, the cap screws are removed first. The blocks are then forced out with tool 65.

Figure 9:
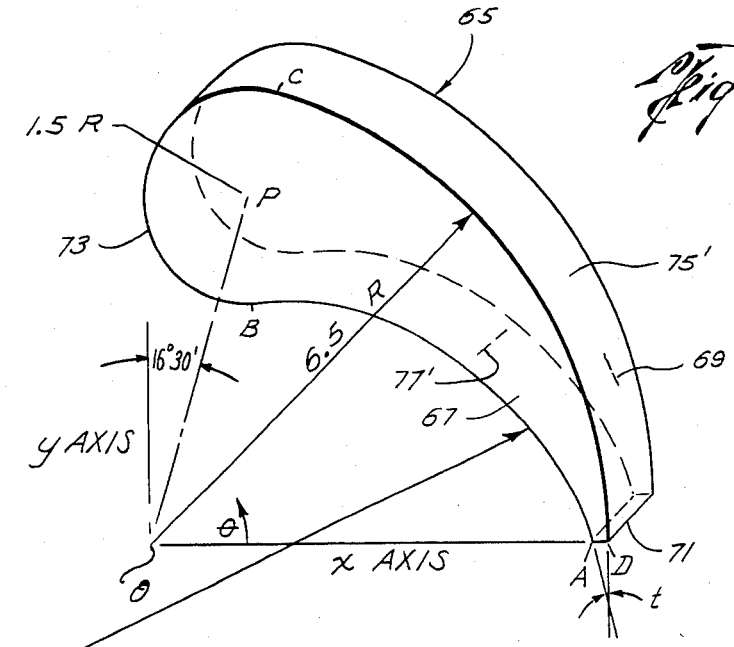
FIG. 9 is an isometric view of a tool in accordance with the invention.

Referring now to FIG. 9, tool 65 is a wedge having parallel plane sides 67, 69, a plane tip 71, from B to C a cylindrically curved head 73, from C to D a cylindrically curved bearing edge 75, and from A to B a curved cam edge 77. Cam edge 77 has a curvature defined by the equations $$x = \cos e\,(6.3 - 2.3658e)$$

$$y = \sin e\,(6.3 - 2.3658e)$$

where e=angle in radians, head 73 has a radius of 1.5 inches, and edge 75 has a radius of 6.5 inches, edge 77 is tangent to head 73 at a line through B, and edge 75 is tangent to head 73 at a line through C.

To construct the shape of side 67 (and similarly side 69) one starts with an origin O, draws a horizontal line OD, a curve A B according to the equation given above terminating at B tangent to e.g. a horizontal line through B, a curve B C of 1.5 inch radius centered at P which lies above B, and a curve D C of 6.5 inch radius starting at D on an extension of line O A and terminating at C tangent to curve B C. Curve B C may slightly exceed 180 degrees so that head 73 may be described as being generally semi-cylindrical.

It will be understood that different size tools 65 may be constructed using the same proportions.

Figure 10:
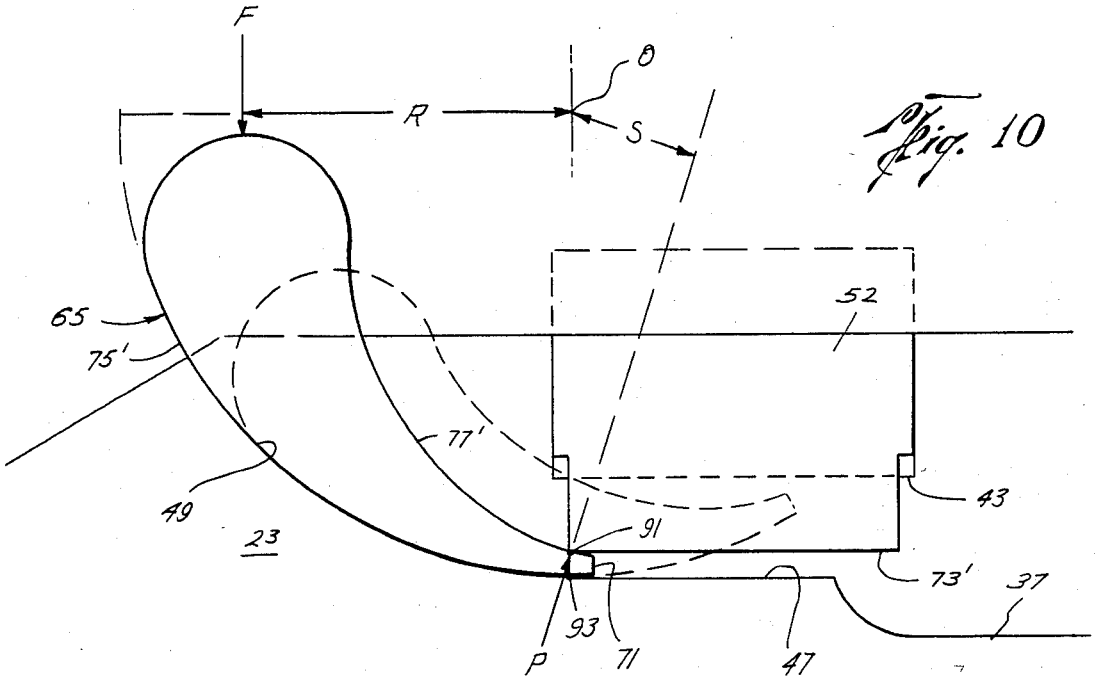
FIG. 10 is a view similar to the sectional portion of FIG. 1 showing to a larger scale employment of the block removal tool of FIG. 9.

Referring now to FIG. 10, there is shown in solid lines a tool 65 cooperating with tool access passage or slot 47 of reamer body 23 for removal of block 52. In dotted lines there is shown the position of the tool and block when the block has been moved out of socket 39 (FIG. 1) far engough to be free.

The tool is initially placed in slot 47 with bearing edge 75 in contact with correlatively cylindrically curved bearing portion 49 of slot 47 with tip 71 underneath block 52 and cam edge 77 in contact with point 91 at the edge of the bottom of the block.

Point 93 is at the portion of the edge that is farthest from pocket 37. Curved portion 49 of the slot is tangent at 93 to the plane bottom of slot 47, the line of tangency lying in a plane passing through point 91 that is tangent to the cylindrical side 93 of block 52. The axis of curvature O of portion 49 lies in the same plane and at a distance of 6.5 inches from line 93.

After placement of the tool in the solid line position hammer blows are struck on the semi-cylindrical head drawing the tool to the dotted line position. As the tool is moved to the dotted line position, it rotates about axis O, bearing edge 75 rotating in bearing portion 49, and cam edge 77 moves under block edge 97, forcing the block out of its socket. Where bottom 73 of the block reaches step 43 of the socket, the block is free. It will be seen that tip 71 never contacts bottom 73.

It will be seen that tool 65 is like a rotary cam in that it rotates about an axis to move one part (block) relative to another part (socket) and is like a wedge in that it is driven by impact.

By virtue of the curves selected for edges 75,77 of the tool, the tool tapers down from head to tip at a constant rate relative to changes in the angular position about axis O and the taper angle t measured between tangents to the edges at intersections with radii from axis O is a constant.

Referring once more to FIG. 10, considering the tool as a lever mounted for rotation about the axis O, it will be seen that neglecting friction, the hammer force F exerted on the head of the tool multiplied by the radial distance R from the part of the head struck by the hammer to the axis O must be equal to force P exerted by the removal tool on the block at point 91 multiplied by the distance S from axis O to a perpendicular to spiral curve 77 at point 91. Therefore, there is a considerable mechanical advantage. The smaller the taper angle X (FIG. 9), the shorter the distance S and the greater the leverage. Also, the smaller the taper angle, the greater the component of P acting in a direction to push the block out of its socket.

Preferably, as shown in FIG. 2, two disassembly or block removal tools are employed, simultaneously, one for each of the two blocks supporting a roller shaft. By removing both blocks together, severe canting of one block that has been removed while the other block tries to remain in place is avoided. The operator will alternately strike hammer blows, first on one removal tool and then on the other.

2. Second Embodiment

Now referring to the drawings, and first to FIG. 11, a stabilizer in accordance with the present invention is shown in longitudinal cross-section. Body 110 of the illustrated stabilizer tool is threaded at threads 112 and 114 for suitable connection to adjoining members cooperatively threaded therewith in the drill string. As is shown, threads 112 appear in the box or lower end of the tool and threads 114 appear in the pin or upper end of the tool, as illustrated. This section of the drill string can alternatively be included in the string in the opposite direction, if desired. The body of the stabilizer includes a fluid circulation hole 16 therethrough and is normally screwed into the drill bit, or, at least, is located not too far above the drill bit. As is noted above, the usual position of a stabilizer is in connection with the collar section, which is 100–300 feet above the bit. Located about the body are a plurality of pockets 117 for accommodating wear-resistant inserts, also referred to as "wear elements" or "wear blades", in accordance with the present invention. For illustration purposes, four such pockets are shown evenly spaced around the circumference of the tool; however, three or more such pockets may be employed, if desired.

Although the wear blades do project or extend beyond the periphery surface of the tool body, it is helpful to include at least shallow angle longitudinal recesses 18 (FIG. 2) between the pockets so as to provide ample outside fluid circulation passage.

Figure 13A:
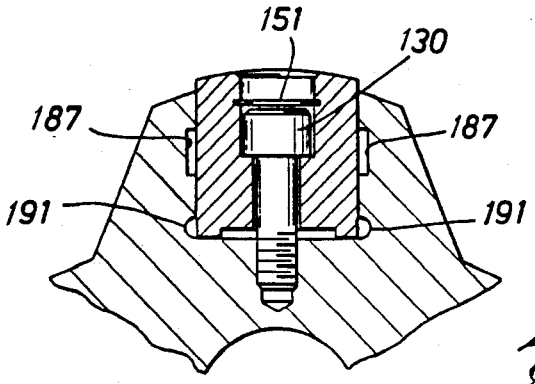
FIGS. 13A through 13E are views similar to FIG. 13 showing modifications.
Figure 13B:
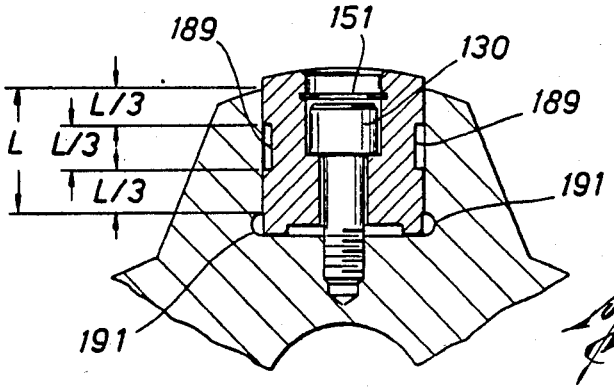
Figure 13C:
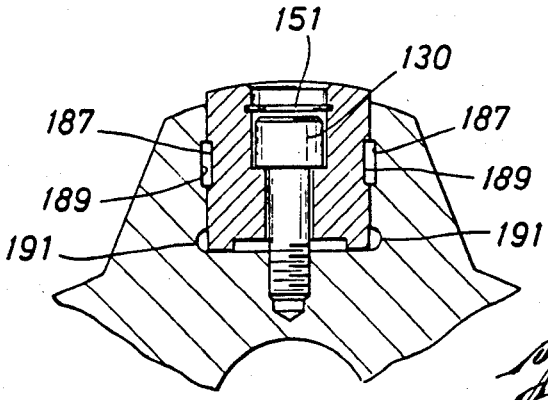
Figure 13D:
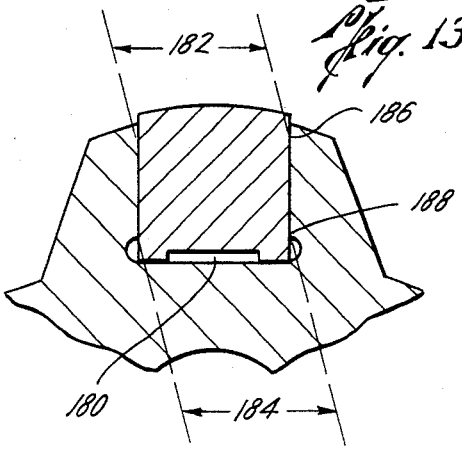
Figure 13E:
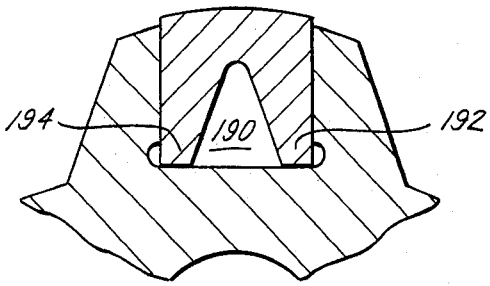
Figure 13F:
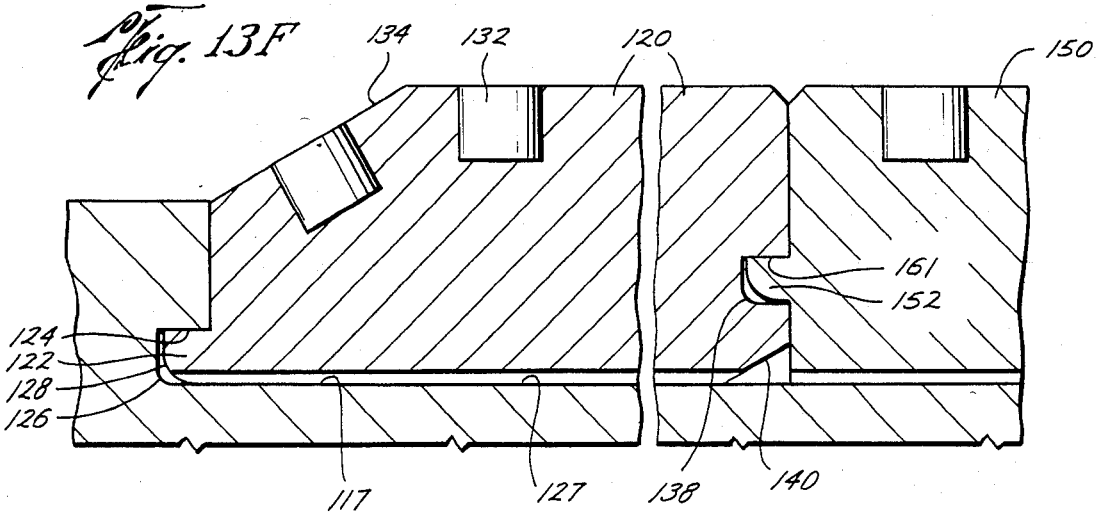
FIG. 13F is a fragmentary enlargement of a portion of FIG. 11.

As is best shown in FIG. 13F, lower blade 120 of a typical series of blade elements located in a stabilizer pocket includes at its lower end an interlock means in the form of a projection 122 or hold-down lip, sometimes referred to as a "tang", at a deep position within the pocket. Projection 122 is suitably accommodated by a mating interlock means in the form of a deep undercut recess 124 in the lower end of pocket 117, preferrably contiguous with seating surface 27 of pocket 117. It should be noted that recess 124 includes a small radius 126 at its deepest location and that adjacent radius 128 of mating projection 122 is a somewhat larger radius for a purpose to be described hereinafter.

Referring once more to FIG. 11, and also to FIGS. 12 and 13, blade 120 is bored at one or more places for accommodating hold-down cap screws 130 and body 110 is bored and tapped from seating surface 127 in alignment therewith for accommodating the cap screws, as shown. It should be noted that the cap screws are countersunk below the exposed or wear surface of the wear element. Further, the wear surfaces of the blades include preferably hard-surface or wear-resistant inserts 32 pressed therein by interference fit, such inserts being made of tungsten carbide steel or the like.

The lower part of each wear blade extends or is exposed beyond the limits of the enlarged section of the body and is tapered at lower taper 134, which also includes one or more inserts 132.

The upper end of the wear blade includes an undercut recess 161 similar to recess 124; however, recess 161 has a location other than adjacent the seating surface or bottom of the pocket. Recess 161 also includes a small radius 138 (FIG. 13F) at its deepest location, again similar to recess 124. A slant surface 140 to receive a drive out tool, as hereinafter described, is undercut in the top of the wear blade adjacent to the seating pocket surface.

Upper blade 150 is similar in construction to lower blade 120 except that lower projection 152 is positioned to be in alignment with receiving recess 161 of the lower blade, rather than a receiving recess adjacent the deep or bottom seating surface of the accommodating pocket, such as with projection 122. Also similar to the lower blade, the blade is bored for the receipt of hold-down cap screws 130 and the body opposite each such bore is bored and tapped for the receipt of such a cap screw. Like the lower blade, the upper blade bores are countersunk and the surface is prepared with hardfacing inserts. A retainer ring 151 may be employed above each of the cap screws as a safety feature against losing an inadvertent loosened cap screw, as shown in FIG. 13.

Figure 13G:
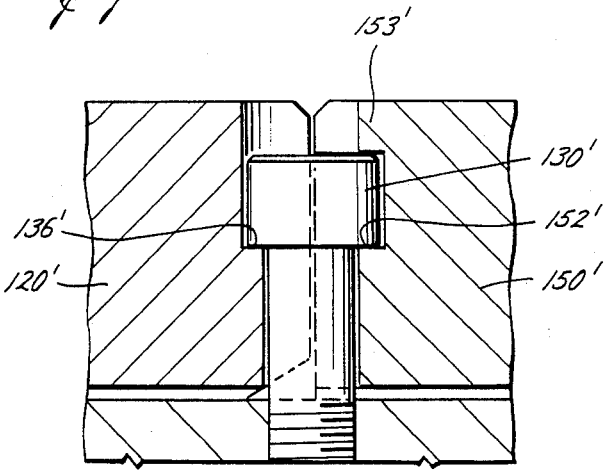
FIG. 13G is a fragmentary view similar to FIG. 13F showing a modification.
Figure 13H:
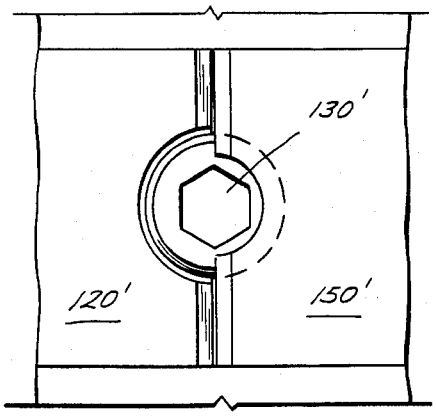
FIG. 13H is a plan view of the modification shwon in FIG. 13G.

FIGS. 13G and 13H show an alternative form of blade retention in which cap screw 130' is located at the juncture of each lower blade 120' and upper blade 150', the head of the cap screw overlying shoulders 135' and 152' on the blade ends, eliminating the need for recess 136 and projection 152.

Referring once more to FIG. 11, except for slight chamfers, there is no tapering of the wear surface upper blade at either end, however, as with taper 134 on the lower blade. The extended wear surface, however, is protected by wear inserts or the like, as in the case with the lower blade.

Still referring to FIG. 11, it will be seen that located adajacent upper blade 150 is block 160, which is provided with a projection 162 for accommodation within recess 161, which is in the upper end of the upper blade and is substantially identical to recess 161 described above for the lower blade. Because of this substantial identity of recesses, the same number is assigned for descriptive purposes. Block projection 162, like blade projections 152 (see FIG. 13F), has a larger radius on its underneath side than the adjacent radius of recess 161, for purposes to be hereinafter described. The contacting or meeting transverse surfaces of upper blade 150 and block 160 are close-fitting or abutting; however, above or outwardly from projection 162, block 160 is spaced apart from top surface 164 of blade 150. Therefore, the only abutment contact between blade 150 and block 160 is at block surface 166 below projection 162. It should be noted that upper blade 150 does include an undercut slant surface adjacent the bottom of the pocket to receive a drive out tool, such as with the lower blade.

Block 160 includes a top surface 168 is close-fitting or abutting with a transverse surface 170 on the top part of the pocket. This transverse surface is at a large, preferably right angle with respect to the longitudinal axis of the tool. However, it should be noted that surface 170 does not extend outwardly to the surface of the body, but there is a space 172 in front of surface 170, as shown. It may also be noted that the top edge surface of block 60 is notched slightly at notch 171 at the top surface of the block to permit the use of a pry out tool (not shown). There is also an undercut at notch 173 next to the seating surface of the pocket to facilitate seating of block 160.

Block 160 is held in position, in addition to projection 162, by one or more cap screws. Block 160 is bored for such cap screws 130 and the body of the tool is bored and tapped opposite such block bores to accommodate these cap screws. The cap screws may be countersunk in the block, although it should be noted that the block does not extend above the surface limits of the body and certainly not above the wear surface of blade 150.

Each of the wear blades 120, 150, as shown in FIGS. 12 and 13, has approximately parallel sides wherein the sides of the wear blade are dimensioned so as to form an interference fit with the approximately parallel sides of the accommodating pocket. Furthermore, it may be noted that there is a void 180 deep within the pocket to provide for liquid and debris passage and to assure metal-to-metal seating of the blade within the pocket of the body.

One way of insuring a tight interference fit, so that the blade does not become loose even in the presence of extremely hard operating conditions, is to dimension the blade and the accommodating pocket in a manner hereafter described. Assuming that the pocket sides are parallel as shown in FIG. 13D, the width dimension at blade periphery 182 is made to be slightly greater than the width dimension of the periphery of the blade at 184, deeper within the pocket. Alternatively, if the sides of the blade are parallel, it is possible to dimension the width dimension at the periphery of the pocket near the body surface at 186 to be slightly smaller than the dimension between the sides of the pocket deeper within the pocket, at contacts 188.

It should be noted that such a structure is contrary to that achieved in ordinary machining, which inherently for a slot such as the pocket shown, makes the external portion of the pocket slightly larger than the internal portions, even though the intent of the machining is to make the sides absolutely parallel.

The principal objective of the lateral interference fit is to insure that each blade component is held tightly at the mouth of the respective pocket or slot and snugly at the bottom of the slot. When a tangential force is applied to a blade component, the blade tends to bend about one edge of the mouth and pull loose from the other edge. If there is any separation, drilling fluid (which is abrasive) will work its way into the crack, and there will also be fretting which will gradually loosen the blade. On the other hand, if the blade component remains gripped by the mouth of the slot, it will make little difference how tightly the bottom of the slot grips the blade so long as it is a snug fit to prevent rocking of the blade in the slot. There is very little force tending to pull the blade component radially out of the slot and the screws satisfy that holding requirement.

In view of the foregoing and the fact that reduced-interference-fit gripping of each blade component will make it easier to insert during manufacture and remove for assembly, it may be preferred to interrupt the interference fit along one or both sides (between the mouth and the bottom of each blade).

Referring now to FIGS. 13A, 13B, and 13C, which are views similar to FIG. 13 showing modifications, such interruption can be effected either by providing relief grooving in one or both sides of each slot, as shown at 187 in FIG. 13A, or at one or both sides of each blade component, as shown at 189 in FIG. 13B, or in both the slot and blade components, as shown in FIG. 13C. As there shown, the relief grooves occupy about one-third of the radial extent L of the side of each blade component or slot that would be engaged absent the groove and are positioned about midway of such radial extent. In this regard it may be noted that the sides of the blades do not engage the slots immediately adjacent the bottoms due to the fillets 191. Other widths and positioning of the grooving may be employed.

Although relief grooves 187 and 189 are of rectangular cross-section and extend the full lengths of the sides of each slot and blade component, other cross-sections and lengths of grooving can be used.

An alternate wear blade structure which insures a tighter gripping of the blade near its external periphery than at an internal periphery location as shown in FIG. 13E. In such a structure, the blade is slotted at slot 190 from end-to-end to provide legs 192 and 194, which are more resilient or flexible than at the external periphery when the metal is slightly deformed in establishing the interference fit connection. It should be noted that slot 190 is fairly large and preferably, as shown, is cut more than half the distance of the length of the interference fit.

In the FIG. 13E embodiment, the machining of the pocket sides and the wear blade sides is such to provide an interference fit in normal fashion. However, when the blade is forced into the pocket, legs 192 and 194 flex slightly inwardly, being somewhat more resilient than the outer periphery dimension of the wear blade, with the result being that the blade is held more tightly in the pocket at its outer periphery than its internal periphery.

If a slot, such as above described for receiving blade components, is cut in a flat bar of dimensions considerably larger than the slot, e.g., by first roughing out the slot and then finish cutting the sides with a cantilever shaft milling cutter, the resulting slot may have nearly parallel sides. However, bending moment on the rotating tool used for finishing the slot will cause the mouth of the slot to be slightly wider than the bottom of the slot.

If a blade component having parallel sides is driven into a slightly narrower slot having parallel sides, the compressive stress in the inner part of the blade component, near the bottom of the slot, will be greater than that at the mouth of the slot. That is because at the bottom of the slot expansion is resisted not only by compressive forces in the metal at the sides of the slot but also by tensile forces in the metal at the bottom of the slot.

If a cylindrical steel body is provided with a plurality of azimuthally spaced paraxial parallel sided slots and a slightly wider parallel sided blade component is driven into each slot, the compressive stress at the mouth of each slot will be less than that at the mouth of each slot in a comparable situation in a flat body of steel. That is because there is more metal at the outer periphery of the cylindrical body to absorb the strain than there is nearer the axis of the body. The same result is true if the slots are in arms that are thicker near the bottoms of the slots than at the mouths, e.g., due to the provision of flow channels as shown at 118 in FIG. 12.

Summarizing, for a variety of reasons there is a tendency for an intended uniform interference fit of the blade components and body slot to produce greater compressive stress at the bottom of the slot. If the stress at the bottom of the slot is greater than at the mouth of the slot, the once parallel sides of the slot no longer are such, instead they flare outwardly resulting in forces tending to push the blade components out of the slot. The slight taper will be less than the friction angle, so the taper will be a seizing taper. Nevertheless, only a certain amount of interference stress can be tolerated if the blade components are to be driven in and driven out, and the most important place for a stressed fit is at the mouth of each pocket or slot, rather than at the bottom. So for maximum retentivity compatible with assembly and replacement, the stress should be greatest at the mouth of the slot and minimal at the bottom of the slot. If all the stress is at the bottom and the mouth is free, the blade components will tend to wiggle out of the pockets or slots. According to the invention this tendency is overcome by providing fits that insure that the stress on the blade components is uniform or else is greater at the mouths of the slots than at the bottoms of the slots.

If the foregoing result is achieved, no particular amount of interference or compressive stress is required beyond that needed to resist external forces tending to pull the bladed components out of their slots. The actual interferences required to achieve the desired result will not vary much with the size of the tool, for the bigger tools there will be bigger areas of engagement between blade components and slots, resulting in greater retention forces for the same amount of interference. As illustrative of a suggest amount of interference that may be suitable, the mouth interference may be 2 to 5 thousandths of an inch and the bottom interference may be 1 to 4 thousandths of an inch. That is, the greater width of the blade may be 2 to 5 thousandths of an inch greater than the width of this slot or pocket at the mouth thereof, and 1 to 4 thousandths of an inch greater than the width of the slot or pocket at the bottom thereof. In other words, there may be 1 or 2 thousandths more interference at the mouth than at the bottom of each slot with 2 to 5 thousandths interference at the mouth and even down to zero interference at the bottom. Note that if the interference is too great at the bottom, it may not be possible to drive the blade components into the slots, or else the sides of the slots and blade components may be galled, or the outer faces of the blade components may be damaged, even if a soft steel or lead mallet is used to drive the blades into the slots.

The foregoing interference values are for solid blade components. If the blades are V slotted as shown in FIG. 13E, or otherwise relieved along the inner edges, so as to make the sides flexible, then a uniform interference from mouth to bottom of, e.g., 2 to 5 thousandths would be suitable.

Figure 14:
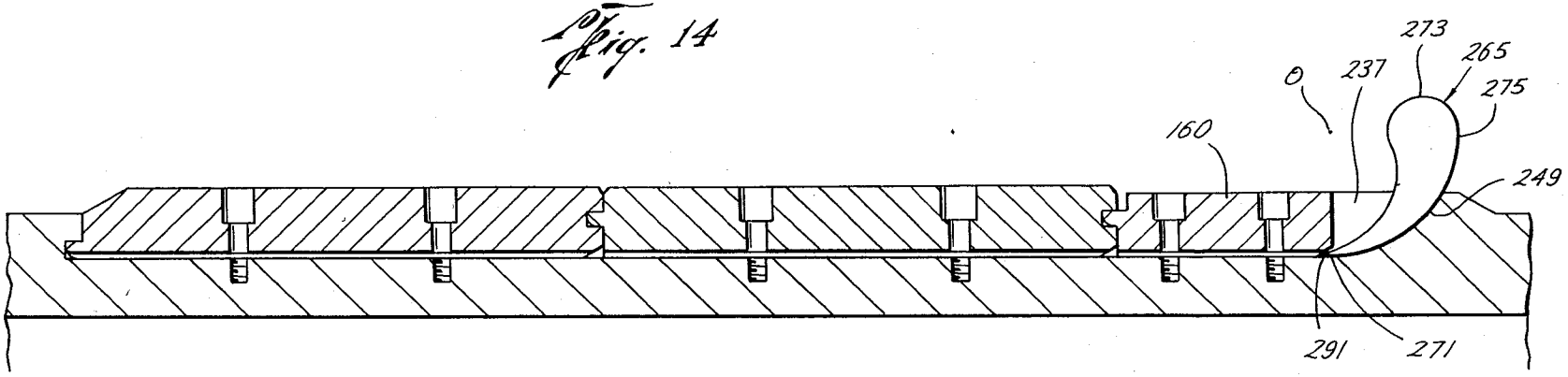
FIGS. 14–17 are views similar to the mid portions of FIG. 11 showing steps in the use of the removal tool in accordance with the invention.
Figure 15:
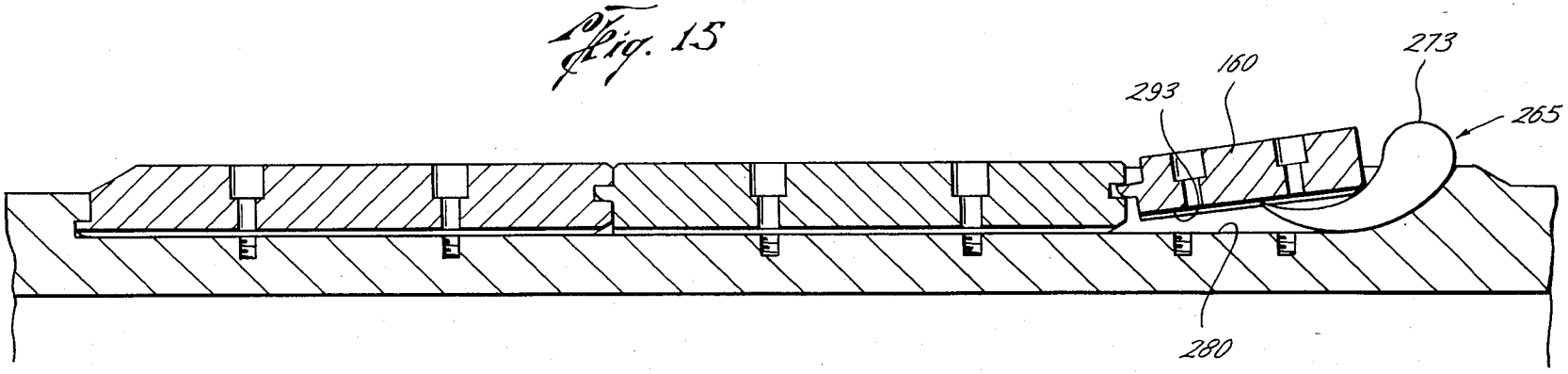

Referring now to FIGS. 14 and 15, there is illustrated the removal of the end section 260 of one of the replaceable blades of the stabilizer. The two cap screws holding the end section to the body have been removed. Tool 265 has been placed in tool passage 237 with its bearing edge 275 in engagement with bearing surface 249. Bearing surface 249 is cylindrically curved centered on axis O directly over the end of section 260 and tangent directly thereunder to the plane bottom 280 of slot 237. Tool 265 is the same as tool 65 except for tip 271 which comes to a point so as to fit under the bevelled edge 291 of section 160, as shown in FIG. 14, and then into channel 293 under the section, as shown in FIG. 16.

Figure 18:
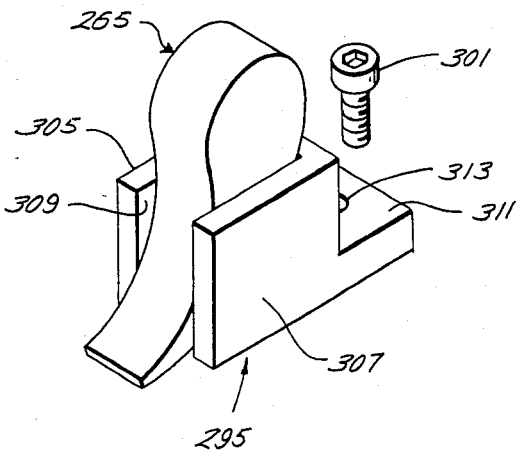
FIG. 18 is an isometric view of the tool and ancillary equipment in accordance with the invention employed in the steps illustrated in FIGS. 16 and 17.
Figure 16:
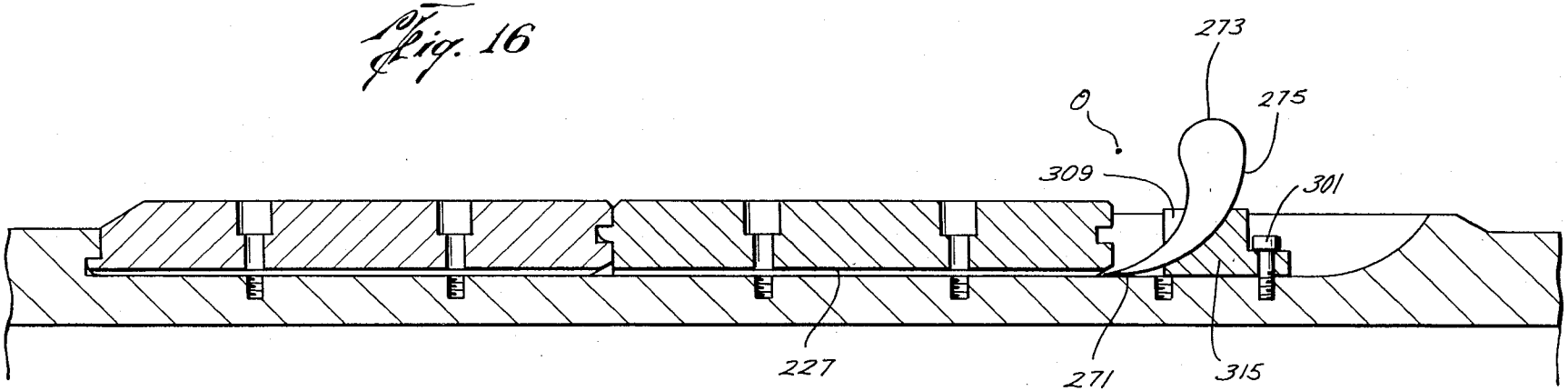
Figure 17:
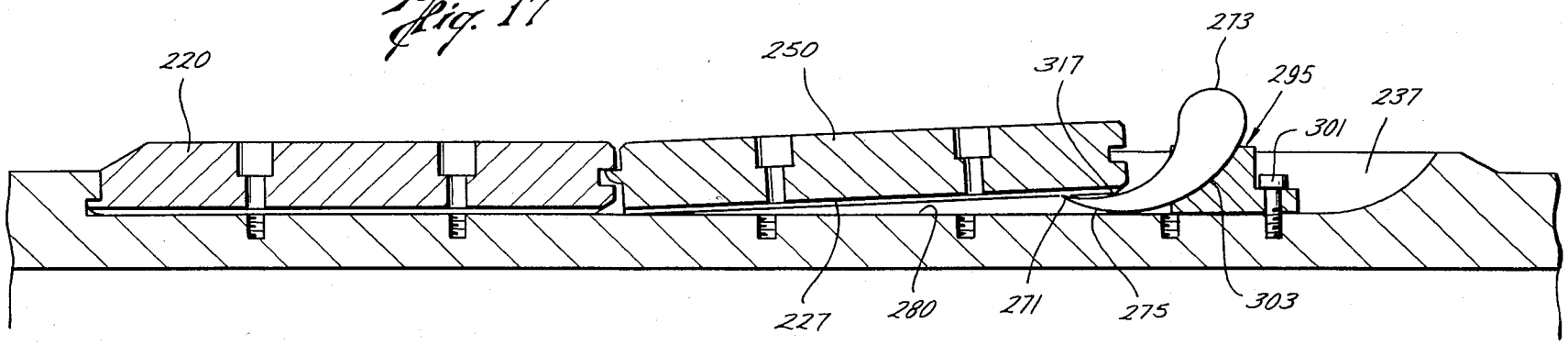

Referring now to FIGS. 16, 17, and 18, after end section 160 has been removed, adapter 295 is placed in the bottom of channel 170 in the position formerly occupied by end section 160 and secured by cap screw 301. Adapter 295 provides a cylindrically curved bearing surface 303 like bearing surface 249, correlative to bearing edge 275 of tool 265.

Referring especially to FIG. 18, adapter 295 includes parallel sides 305, 307 forming a guide slot 209 (FIG. 16) a base plate 311 has a hole 313 to pass screw 301. Midportion 315 (FIG. 16) provides bearing surface 303.

As shown in FIG. 16, tip 271 of tool 265 is initially positioned to extend into the end of channel 227 in the bottom of blade section 250. Then head 273 is struck with a hammer, driving the tip of the tool farther into channel 271 and elevating tip 271 to lift section 250 out of slot 280, as shown in FIG. 16. In similar fashion, the other blade sections, e.g. 220, can be removed, adapter 295 being repositioned adjacent thereto after the previous section, e.g. 250, has been removed.

As shown in FIG. 17, in the initial stages of removal of sections 250, tip 271 is out of contact with the bottom of the section, the tool making line contact with the edge 317 of the section. Only when starting, as in FIGS. 14 and 16, and at the end of the tool travel as in FIG. 15, does tip 271 contact the bottom of the blade section. The main work of the tool is therefore accomplished without loading the tip.

CONCLUSION

It will be noted that in both of the above-described embodiments of the invention a convex cylindrically curved bearing surface or edge on the removal tool cooperates with a correlative concave bearing surface on the body of the reamer or stabilizer device, formed integral therewith or attached thereto, to constrain or guide the motion of the tip; to rotation about an axis O located directly above the end of the block or section being removed, and the concave bearing surface is tangent to the plane bottom of a slot beneath the block or section.

In each embodiment, the tool has a cam surface or pressure portion whose cross section is an Archimedian spiral, i.e. one in which the radial distance varies linearly with the angle according to the polar coordinate equation $r=cx$ where r is the radius, c is a constant and x is the angle so that the wedging order is uniform.

In each case the head is cylindrically curved to receive slightly inclined hammer blows more effectively.

In operation the reamer or stabilizer or similar device from which a part is to be removed is placed with its axes horizontal, e.g. on the ground or on saw horses, and the removal tool is positioned under its tip with an edge of the part to be removed. The head of the tool is struck with a sledge hammer causing rotation of the tool whereby the part to be removed is driven out and released from its interference fit with the device. Because of the rounded head of the tool, there is always presented a horizontal top portion for striking with the sledge hammer as the tool rotates about the bearing axis O.

While preferred embodiments of the invention have been shown and described, modifications thereof can be made by one skilled in the art without departing from the spirit of the invention.

ADDENDUM

The cross section of the tool need not be rectangular as shown. For example a generally triangular cross section would be appropriate for use with the embodiment of the stabilizer blade section shown in FIG. 13E.

The tip of the tool need not be pointed in the Second Embodiment.

Preferably the tool is designed so that there is no contact of the tip with the part being removed, so that there is no load on the tip.

I claim:

1. Apparatus for disassembly of a wall contacting device, such device having a body with a socket therein and a block making an interference fit with the socket and removable out of the socket by movement in a certain direction, said block having a part facing away from the direction the block must move for removal from the socket, said apparatus comprising:

passage means in such device via which a disassembly tool can be placed for exerting force on the block to effect such removal, a disassembly tool removably received in said passage means, said tool having a pressure portion engaged with said part of the block and a head portion exposed to the exterior of the device for receiving force, and cooperting guide means on the body and tool for guiding the tool to impart a certain motion thereto to keep said pressure portion engaged with said part of the block as the block moves out of the socket in response to force applied to said head, said certain motion consisting of rotation in parallel planes, perpendiculars to which are transverse to said certain direction of movement of the block, said cooperating guide means comprising surfaces on said body and tool both of which surfaces are cylindric about a common axis perpendicular to said planes, the radial distance from said axis of each of said surfaces being a constant and the radial distance of one of said surfaces from said axis being equal to the radial distance of the other of said surfaces from said axis, said cylindric surface of the body supporting the tool over the area of engagement of said cylindric surfaces during motion of the tool to resist galling and gouging, said certain motion of said tool during block removal being pure rotation about the axis of said cylindric surfaces, tending to prevent translatory rebound upon sudden application of force to the head portion of the tool, said axis of rotation being stationary relative to said tool passage.

2. Apparatus for disassembly of a wall contacting device, such device having a body with a socket therein and a block making an interference fit with the socket and removable out of the socket by movement in a certain direction, said block having a part facing away from the direction the block must move for removal from the socket said apparatus comprising:

passage means in such device via which a disassembly tool can be placed by exerting force on the block to effect such removal, a disassembly tool removably received in said passage means, said tool having a pressure portion engaged with said part of the block and a head portion exposed to the exterior of the device for receiving force, and cooperating guide means on the body and tool for guiding the tool to impart a certain motion thereto to keep said pressure portion engaged with said part of the block as the block moves out of the socket in response to force applied to said head, said certain motion consisting of rotation in parallel planes, perpendiculars to which are transverse to said certain direction of movement of the blocks, said cooperating guide means comprising surfaces on said body and tool both of which surfaces are cylindric about a common axis perpendicular to said planes, said cylindric surface of the body supporting the tool over the area of engagement of said cylindric surfaces during motion of the tool to resist galling and gouging, said certain motion of said tool during block removal being pure rotation about the axis of said cylindric surfaces, tending to prevent translatory rebound upon sudden application of force to the head portion of the tool, said axis of rotation being stationary relative to said tool passage, said pressure portion including a pressure surface making sliding engagement with said block and urging said block to outward movement from the socket as the tool rotates in a direction corresponding to inward motion of said head portion, i.e. contrariwise to the direction of movement of the block, said pressure surface having an axis coaxial with said axis of rotation of the tool, all cross-sections perpendicular to the axis of said pressure surface being alike portions of Archimedean spirals whose centers all lie on said axis of said pressure surface, whereby the distance between said pressure surface where it engages said block and said cylindric surface of the tool increases in direct proportion to the angular extent of rotation of the tool about said axis so that removal of said block is uniform relative to such angular motion.

3. Apparatus according to claim 1 or 2;

the distance from a plane through the tool rotation axis parallel to said direction of movement of the block to said pressure portion of the tool where it engages the block being zero.

4. Apparatus according to claim 2;

said head portion having a cylindric exterior surface whose axis is parallel to said axis of rotation of the tool, said cylindric exterior surface presenting a radius parallel to said direction of movement of the block in all positions of said tool when it is engaged with the block throughout said rotation of the tool.

5. Apparatus according to claim 1 or 2;

the line of contact of said cylindric surfaces which is parallel to said axis and is most remote from said pressure portion of the tool being farther from a plane through said block in said direction of movement thereof which plane passes through said pressure portion where it engages said block than is a line through said head portion parallel to said line of contact and lying in a plane perpendicular to said direction of movement that is farthest from said pressure portion where it engages said block, whereby force applied to said head portion at said line through said head portion in the direction opposite to said direction of block movement does not tend to rotate said tool out of engagement with said passage means.

6. Apparatus according to claim 2;

said pressure portion including a pressure surface making engagement with said part of the block and urging said block to outward movement in the socket as the tool rotates in a direction corresponding to inward motion of the head portion, i.e. contrariwise to the direction of movement of the block, said pressure surface being generated by a straight line moving laterally parallel to said axis of tool rotation, said part of the block being a plane surface perpendicular to said direction of movement of said block and facing said passage means of the body, said block having cylindrical sides adjacent said part of the block that is a plane surface, said engagement of said block and pressure surface being at a point at the juncture of said cylindrical side walls and said part of the block that is a plane surface.

7. Apparatus according to claim 2;

said pressure surface of said tool making contact with said block, said pressure surface extending from the locale of initial engagement of said pressure surface and said block to said head portion, said head portion having a cylindric exterior surface tangent to said pressure surface, the plane of tangency of said pressure surface and said cylindric exterior surface of said head when said tool initially engages said block being parallel to said direction of movement of said block, said cylindric exterior surface extending at least 180 degrees from said plane of tangency and presenting a radius parallel to said direction of motion of the block in all positions of said tool when it is engaged with the block through said rotation of the tool.

8. Apparatus according to claim 6;

said plane surface of said part of the block being separated from said passage means of the body, the extreme tip of said tool farthest from said head portion extending beyond the point of engagement of said pressure surface and block part into the space between said block part and passage means and being at all times out of engagement with said block prior to movement of said block from said socket all the way out of interference fit with said socket.

9. Apparatus according to claim 2, said apparatus including said device, said body of said device including a second socket therein and a second block making an interference fit with the second socket and removable out of the second socket by movement in a direction the same as the direction for removal of the first mentioned block, a rigid member inter-connecting said blocks, and passage means, disassembly tool, and guide means for said second block the same as those for the first said block, whereby said blocks can be removed contemporaneously so as to avoid canting of one block due to its being connected through the rigid member to the other as yet unmoved block.

10. Disassembly tool comprising a body having parallel planar sides, a cylindrically curved bearing surface joining said sides, the axis of said cylindrically curved bearing surface being perpendicular to said sides, a pressure surface joining said sides, said pressure surface being curved, cross sections of said pressure surface perpendicular to said axis of said bearing surface being portions of alike Archimedean spirals concentric with said bearing surface, said tool between said surfaces tapering toward a single tip extending continuously between said sides and flaring away from the tip, said tool having a head, said head having an impact surface which is cylindrically curved about an axis parallel to the axis of curvature of said bearing and pressure surfaces, said impact surface being tangent to said bearing and pressure surfaces.

11. Tool according to claim 10, said tool including;

a guide member having parallel sides defining a slot within which said body is disposed with its sides parallel to those of said guide member, said guide member having a cylindric bearing surface at the bottom of the slot correlative to and concentric with said bearing surface of said body of the tool.

12. Tool according to claim 11;

said guide member having a flat base, said base having a hole therethrough for receiving a cap screw to hold it to a device from which a part is to be removed.

* * * * *

UNITED STATES PATENT AND TRADEMARK OFFICE

CERTIFICATE OF CORRECTION

PATENT NO. : 4,497,384

DATED : FEBRUARY 5, 1985

INVENTOR(S) : LAWRENCE D. HART

It is certified that error appears in the above—identified patent and that said Letters Patent is hereby corrected as shown below:

Column 1, line 23; before "tool" insert -- wedge --.

Column 1, line 24; before "tool" insert -- wedge --.

Column 2, line 60; delete "of" (First occurrence).

Column 4, line 42; delete "or" and insert -- of --.

Column 4, line 63; change "not" to -- no --.

Column 5, line 27; change "within" to -- with one --.

Column 5, line 29; change "with" to -- into --; change "place when" to -- place. When --.

Column 5, line 30; delete "worm" and insert -- worn --.

Column 6, line 6; delete "worm" and insert -- worn --.

Column 6, line 22; change "axil" to -- axial --.

UNITED STATES PATENT AND TRADEMARK OFFICE

CERTIFICATE OF CORRECTION

PATENT NO. : 4,497,384

DATED : FEBRUARY 5, 1985

INVENTOR(S) : LAWRENCE D. HART

It is certified that error appears in the above—identified patent and that said Letters Patent is hereby corrected as shown below:

Column 8, line 16; change "27" to -- 127 --.

Column 8, line 30; change "32" to -- 132 --.

Column 9, line 33; change "60" to -- 160 --.

Column 11, line 62; change "suggest" to -- suggested --.

Column 12, line 40; change "209" to -- 309 --.

Column 13, line 16; change "under its tip with" to -- with its tip under --.

Signed and Sealed this

*Third* Day of *September 1985*

[SEAL]

*Attest:*

DONALD J. QUIGG

*Attesting Officer* *Acting Commissioner of Patents and Trademarks - Designate*